US011054207B2

(12) United States Patent
Martin

(10) Patent No.: US 11,054,207 B2
(45) Date of Patent: Jul. 6, 2021

(54) INTEGRALLY SUPPRESSED FIREARM UTILIZING SEGREGATED EXPANSION CHAMBERS

(71) Applicant: Scott R. Martin, Sun Valley, NV (US)

(72) Inventor: Scott R. Martin, Sun Valley, NV (US)

( * ) Notice: Subject to any disclaimer, the term of this patent is extended or adjusted under 35 U.S.C. 154(b) by 0 days.

(21) Appl. No.: 16/599,123

(22) Filed: Oct. 11, 2019

(65) Prior Publication Data

US 2020/0166304 A1 May 28, 2020

Related U.S. Application Data

(60) Provisional application No. 62/766,297, filed on Oct. 11, 2018.

(51) Int. Cl.
*F41A 21/30* (2006.01)
*F41A 21/24* (2006.01)

(52) U.S. Cl.
CPC ..... *F41A 21/30* (2013.01); *F41A 21/24* (2013.01)

(58) Field of Classification Search
CPC ..... F41A 21/30; F41A 21/24; F41A 21/00; F41A 21/26; F41A 21/28; F41A 21/325; F41A 21/36; F41A 21/44
USPC ..... 89/14.4
See application file for complete search history.

(56) References Cited

U.S. PATENT DOCUMENTS 1,004,665 A * 10/1911 Lewis ..... F41A 21/30 89/14.1
1,111,202 A * 9/1914 Westfall ..... F41A 21/30 89/14.4
1,140,578 A * 5/1915 Coulombe ..... F41A 21/30 181/223
1,173,687 A * 2/1916 Thompson ..... F41A 21/30 89/14.4
1,227,897 A * 5/1917 Dunwoody ..... F41A 13/12 89/14.1
1,229,675 A * 6/1917 Thompson ..... F41A 21/30 89/14.3
1,554,051 A * 9/1925 Walker ..... H01H 9/0005 89/14.3
2,337,840 A * 12/1943 Scott-Paine ..... F41A 13/12 89/14.1
2,916,970 A * 12/1959 Mutter ..... F41A 21/00 89/14.3

(Continued)

*Primary Examiner* — Joshua E Freeman
(74) *Attorney, Agent, or Firm* — Ricky Lam

(57) ABSTRACT

Methods and systems for limiting the sudden expansion of propellant gasses, products of combustion when firing a gun, exiting a barrel of a gun, which otherwise would result in a very loud noise, sharp "recoil" of the gun, and a pronounced "muzzle flash" if released unrestricted. By utilizing two or more completely segregated, or partially segregated, expansion chambers, the gasses can be allowed to sequentially expand and cool under tightly controlled conditions governed by the size and location of holes, or passageways, in the barrel which communicate with the interior of the expansion tube that encompasses the barrel. The expanding gasses are further controlled by the locations and volumes of each segregated expansion chamber, and holes in the structural vertical and horizontal bulkheads of the expansion tube, which can "steer" the gasses in order to achieve easy expansion as well as gas flow disruption goals by design.

10 Claims, 13 Drawing Sheets

(56) References Cited

U.S. PATENT DOCUMENTS

| | | | | |
|---|---|---|---|---|
| 5,097,614 | A * | 3/1992 | Strong | F41A 21/28 42/76.01 |
| 5,355,765 | A * | 10/1994 | Rogers | F41A 13/12 89/14.4 |
| 5,753,846 | A * | 5/1998 | Koon | F41A 21/28 42/75.02 |
| 6,575,074 | B1 * | 6/2003 | Gaddini | F41A 21/30 89/14.4 |
| 7,353,741 | B2 * | 4/2008 | Brixius | F41A 13/06 42/90 |
| 7,600,606 | B2 * | 10/2009 | Brittingham | F41A 21/30 181/223 |
| 8,015,908 | B2 * | 9/2011 | Kline | F41A 21/30 89/14.4 |
| D685,874 | S * | 7/2013 | Andrews, Jr. | D22/108 |
| 9,038,771 | B1 | 5/2015 | Mueller | |
| 9,739,559 | B2 * | 8/2017 | Bush | F41A 21/30 |
| 10,386,146 | B2 * | 8/2019 | Spector | F41A 21/44 |
| 10,533,819 | B2 * | 1/2020 | Thomas | F41A 21/30 |
| 2006/0123983 | A1 * | 6/2006 | Vais | F41A 21/30 89/14.3 |
| 2014/0353076 | A1 | 12/2014 | Bethlenfalvy | |
| 2015/0090105 | A1 | 4/2015 | Pace | |
| 2015/0184968 | A1 | 7/2015 | Fischer | |
| 2016/0003570 | A1 * | 1/2016 | Tonkin | F41A 21/04 89/14.4 |
| 2016/0209150 | A1 | 7/2016 | Smith | |
| 2017/0115084 | A1 * | 4/2017 | Hailey | F41A 21/28 |
| 2017/0254609 | A1 * | 9/2017 | Schoenlau | F41A 21/32 |
| 2017/0299291 | A1 * | 10/2017 | Spector | F41A 13/12 |
| 2017/0299312 | A1 | 10/2017 | Llewellyn, Jr. | |
| 2017/0350670 | A1 * | 12/2017 | Grob | F41A 21/18 |
| 2018/0238652 | A1 * | 8/2018 | Leone | F41A 21/28 |
| 2018/0238653 | A1 * | 8/2018 | Kunsky | F41A 21/325 |
| 2018/0245871 | A1 * | 8/2018 | Goggel | F41A 21/30 |
| 2018/0274873 | A1 * | 9/2018 | Thomas | F41A 21/30 |
| 2019/0017768 | A1 * | 1/2019 | Thomas | F41A 21/30 |
| 2019/0017773 | A1 * | 1/2019 | Myers | F41A 19/13 |
| 2020/0300566 | A1 * | 9/2020 | Baker | F41A 21/22 |

* cited by examiner

VIEW A-A

VIEW B-B

VIEW C-C

INTEGRALLY SUPPRESSED FIREARM UTILIZING SEGREGATED EXPANSION CHAMBERS

CLAIMS OF PRIORITY

This patent application is a continuation-in-part and claims priority from:

(1) U.S. provisional patent application No. 62/766,297, entitled 'An integrally suppressed firearm utilizing segregated expansion chambers', filed Oct. 11, 2018.

FIELD OF THE TECHNOLOGY

The present disclosure relates generally to firearms, and more particularly, to suppressors for firearms.

BACKGROUND

When the trigger is pulled on a loaded gun, the firing pin strikes a primer located at the back of the bullet cartridge causing an ignition of propellant gunpowder in the said cartridge leading to an overpressure in the chamber containing the said cartridge, causing the bullet to be driven the length of the barrel and then exits to impact at some point downrange. The rapidly expanding gasses of the ignited gunpowder, having driven the bullet at a predetermined velocity, exit the barrel under extreme pressure. A sudden release of expanding gasses from the exit of the barrel causes a loud "bang" on the order of 160 decibels. In reference, a decibel rating of 85 is typically listed as "hearing damage possible". The purpose of a sound suppressor being fitted to a barrel is to provide an enclosed space, generally measured in cubic inches (US) or cubic centimeters (EU, and etc.), for the expanding gasses, the products of gunpowder combustion, to expand and cool prior to atmospheric exposure. Also, muzzle flash, a visually observed final burning of any previously un-combusted gunpowder, is virtually eliminated, and any recoil of the gun is reduced. One part of the recoil is due to the extremely high velocity of the exhaust gas from the gun's unsuppressed barrel, e.g. Newton's Third Law. The other part is the bullet's mass acceleration.

Firearm suppression can be desirable for a number of reasons. Firing ammunition can produce sound pressure levels (SPL) that are damaging to hearing. Utilizing firearm suppressors can mitigate those effects by reducing the sound pressure levels associated with operating the firearm. Quieter operation can also provide tactical advantages in military or law enforcement applications, such as, e.g., in covert operations. Noise suppression may also be helpful in civilian contexts, such as, e.g., in firing ranges located near residential areas, or close-quarters self-defense situations in crowded neighborhoods.

A suppressor generally takes the form of a cylindrically-shaped metal tube with various internal mechanisms to reduce the sound of firing by slowing and cooling the escaping propellant gasses, and sometimes by reducing the velocity of the bullet. The suppressor is typically made of metal, such as, e.g., steel, aluminum, or titanium, that can withstand the heat associated with the propellant gasses. Traditionally, suppressors—also referred to as silencers—have been built with an outer tube and internal baffling components. The outer tube is steel or aluminum tubing and has end caps, either welded or threaded in place. The internal components are typically a set of flat disks each having a hole through a center portion with spacers to create a volume of space, referred to as a baffle chamber, between each set of disks. The baffle chambers serve to control, delay, and divert the flow and expansion of propellant gasses, and to reduce temperature and entropy as the gasses ultimately exit the device.

Customarily, a suppressor is fitted to the end of a gun barrel. The suppressed gun barrel prevents the extreme gas velocity exiting directly forward and causing the said recoil and noise output. The said suppressor can be six to 10 inches long or more, and provides approximately seven to 12 (or more) cubic inches of enclosed expansion space. The added length and weight of a suppressor attached to the end of a gun barrel necessarily serves to render the gun more unwieldy and difficult to use in military combat or law enforcement situations. Because the suppressor increases the total length of the firearm and adds weight to the muzzle, it may thus impair the weapon's balance.

Some characteristics of designing a suppressor include the amount and the shape of the chambers. Each chamber reduces the muzzle sound by a given amount and, therefore, a high number of chambers is desirable. In addition, the larger the internal volume of the suppressor, the greater amount of sound is suppressed, and so it is desirable to increase the size of the suppressor.

Despite apparent advantages, there are problems with traditional approaches to firearm suppressor design. Common problems include poor balance, backpressure, baffle strikes, e.g., where the bullet very slightly grazes a baffle wall, and etc. In view of at least the above shortcomings, a need exists for a more efficient, greater gas expansion volume and well-balanced firearm suppressor without adding firearm length and that regulates and redirects expanding gasses created from combustion of a propellant.

SUMMARY

In one aspect, the present invention is directed to a novel means of containing, controlling, and directing the path of expanding gasses that propels a projectile within a barrel of a gun, so as to suppress, or muffle, the acoustic signature of a gunshot. A novel gun silencer is disclosed utilizing segregated expansion chambers, which said chambers are formed within the said silencer's tubular structure using a plurality of baffles. Some of the baffles include holes at various places to re-direct gasses and increase turbulence as the bullet passes through the baffles. Firearm length is not significantly increased, aiding balance to the firearm. In addition, because the bullet is constrained within the barrel (instead of a baffle assembly of a prior art silencer), there is zero chance of a "baffle strike", in which a bullet exiting the barrel comes in contact with the baffle system.

BRIEF DESCRIPTION OF THE DRAWINGS

Both the foregoing brief overview and the following detailed description provide examples and are explanatory only. Accordingly, the foregoing brief overview and the following detailed description should not be considered to be restrictive. Further, features or variations may be provided in addition to those set forth herein. For example, embodiments may be directed to various feature combinations and sub-combinations described in the detailed description.

The accompanying drawings, which are incorporated in and constitute a part of this disclosure, illustrate various embodiments of the present disclosure. In addition, the drawings may contain other marks owned by third parties and are being used for illustrative purposes only. All rights to various trademarks and copyrights represented herein, except those belonging to their respective owners, are vested in and the property of the Applicant/s.

Figure 1:
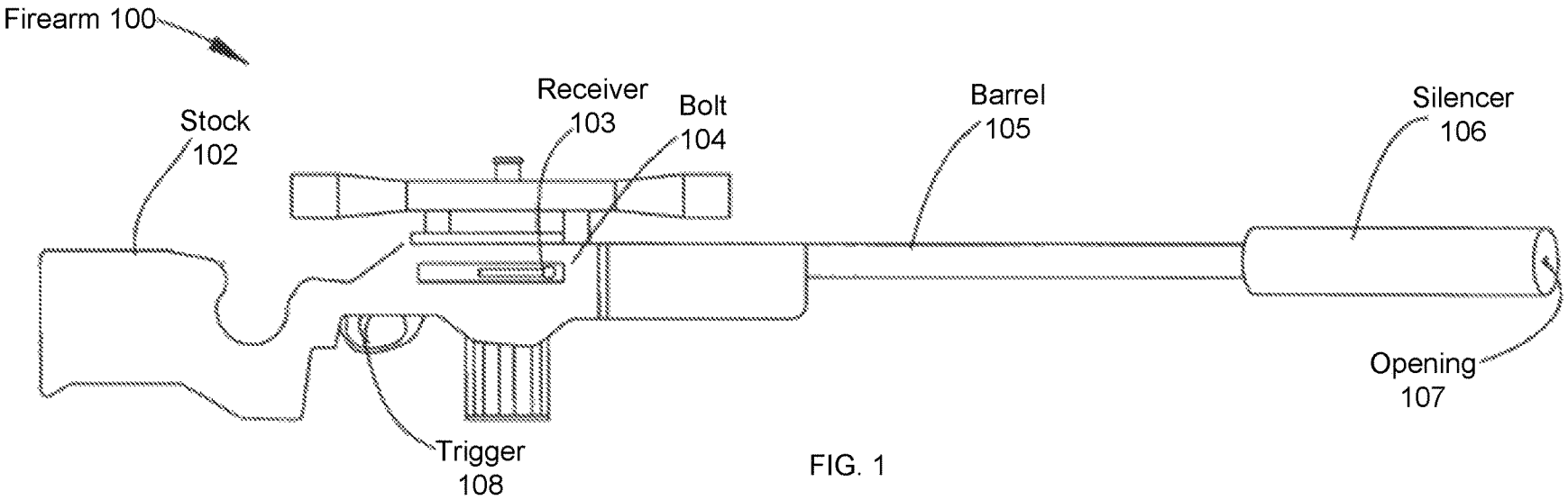

The Applicant/s retain and reserve all rights in their trademarks and copyrights included herein, and grant permission to reproduce the material only in connection with reproduction of the granted patent and for no other purpose.

Furthermore, the drawings and their brief descriptions below may contain text or captions that may explain certain embodiments of the present disclosure. This text is included for illustrative, non-limiting, explanatory purposes of certain embodiments detailed in the present disclosure. In the drawings:

FIG. 1 is an overall side view of a typical gun with a Prior Art silencer mounted at the distal point of the gun.

Figure 2:
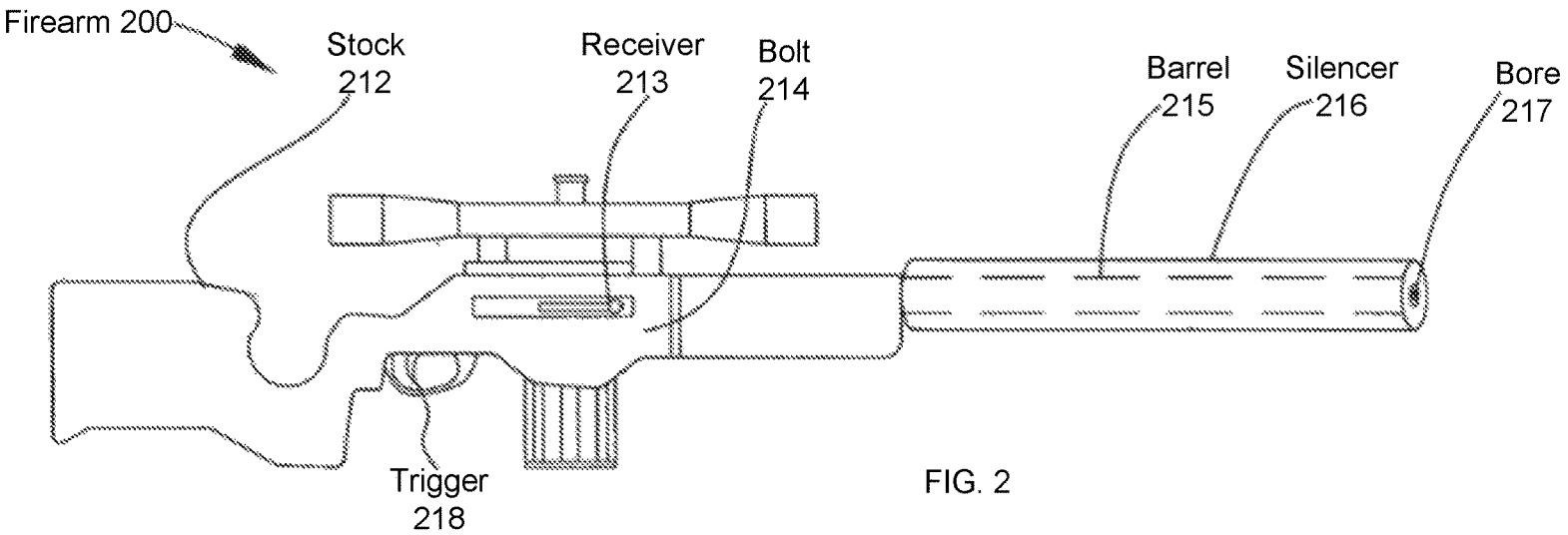

FIG. 2 is an overall side view of a typical gun with a silencer mounted over the gun barrel according to a First Embodiment of present invention.

Figure 3:
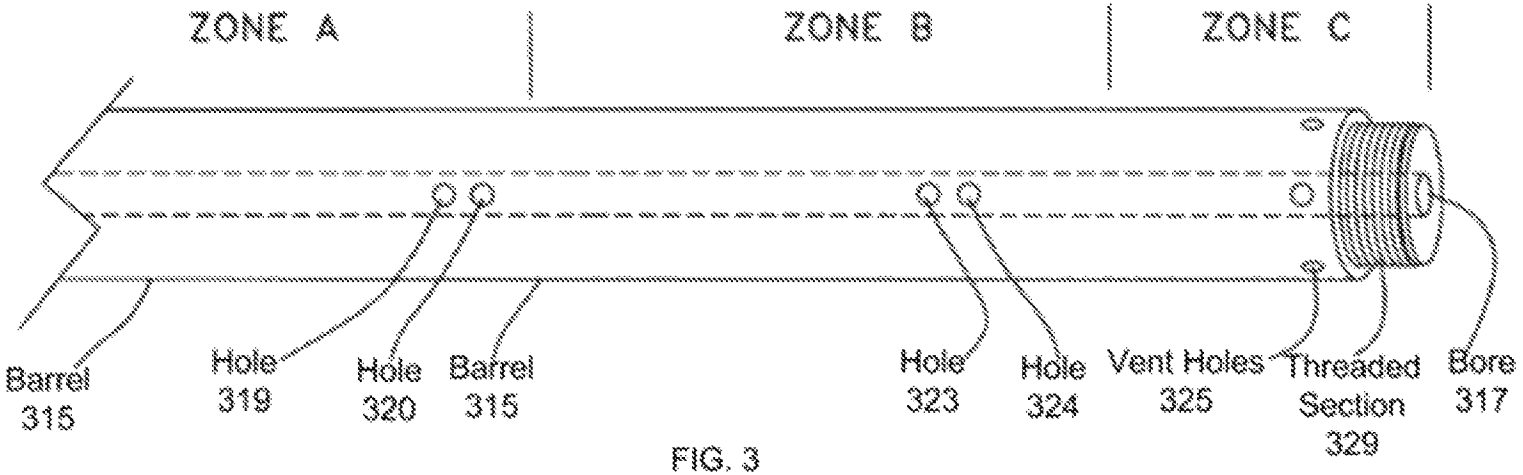

FIG. 3 shows a gun barrel with vent holes in predetermined places.

Figure 4:
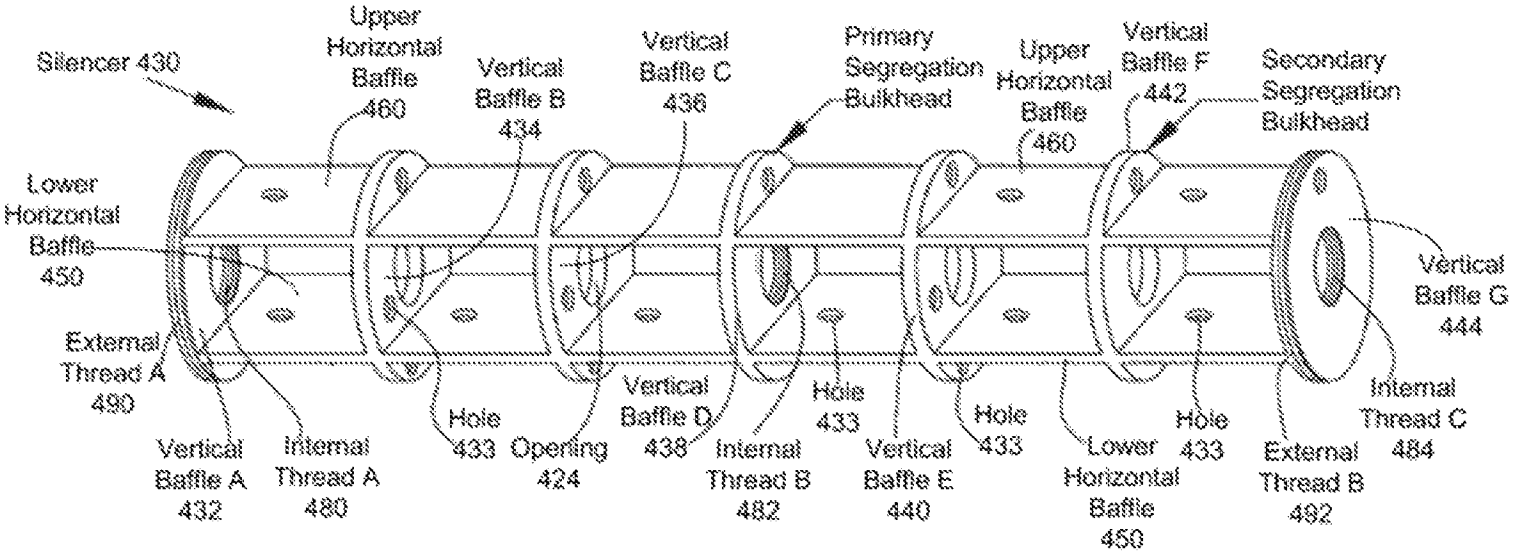

FIG. 4 shows the silencer baffle assembly of the present invention with both vertical and horizontal baffles.

Figure 5:
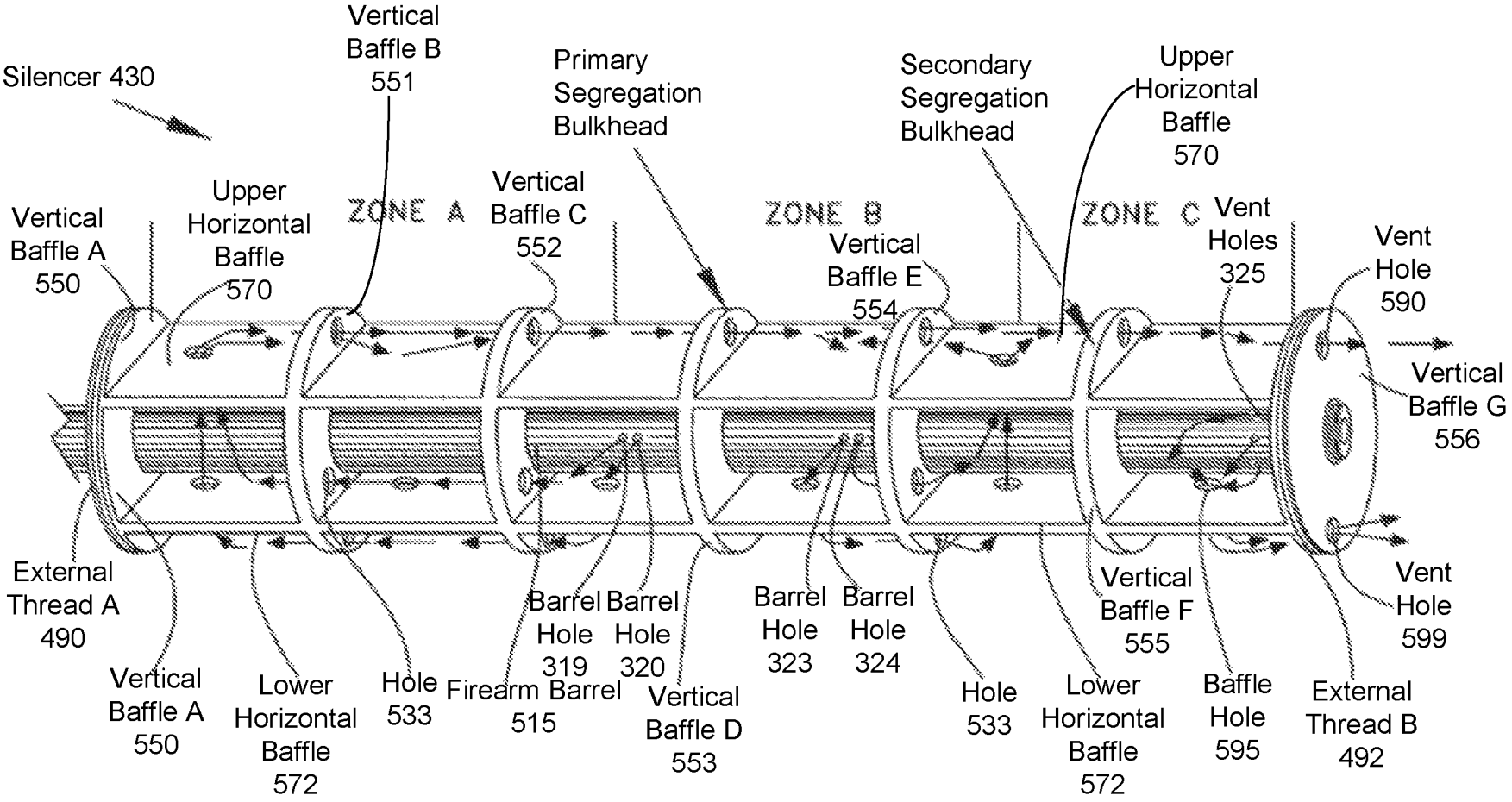

FIG. 5 shows the silencer baffle of the present invention with both vertical and horizontal baffles mounted on a gun barrel, with the silencer tube not shown.

Figure 6:
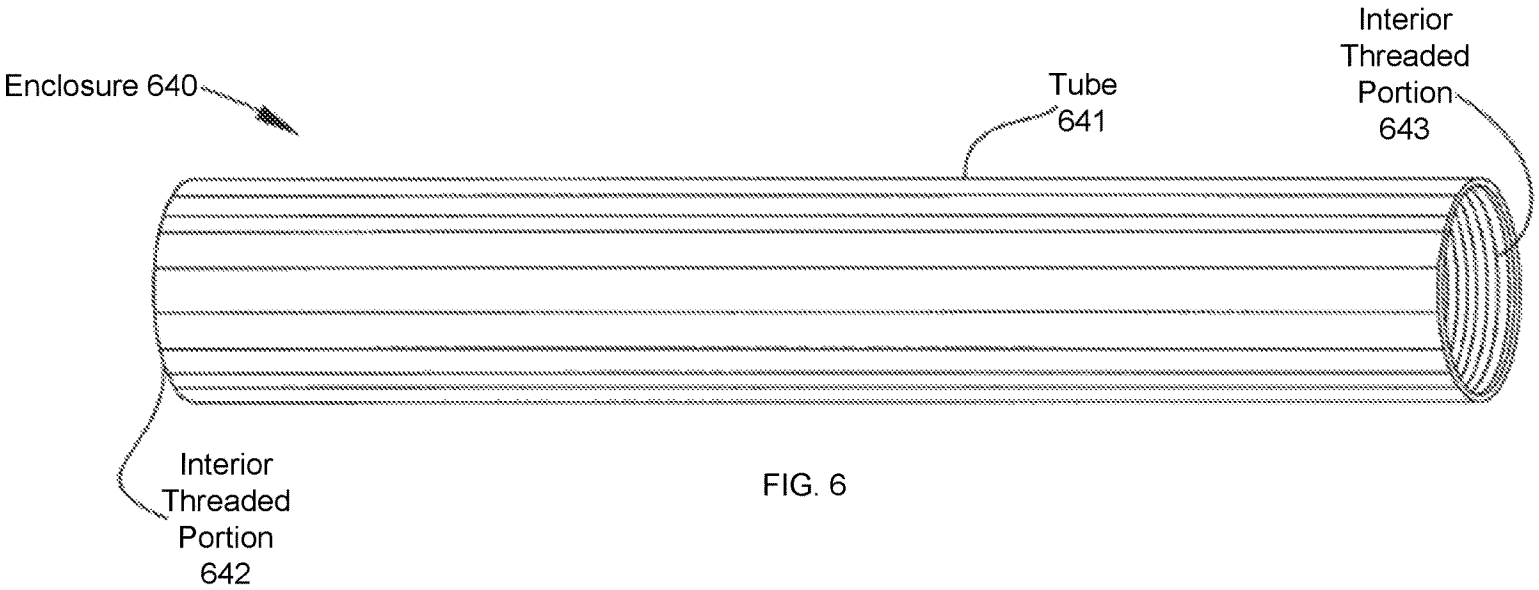

FIG. 6 shows the silencer tubular cover of the present invention with a threaded interior.

Figure 7:
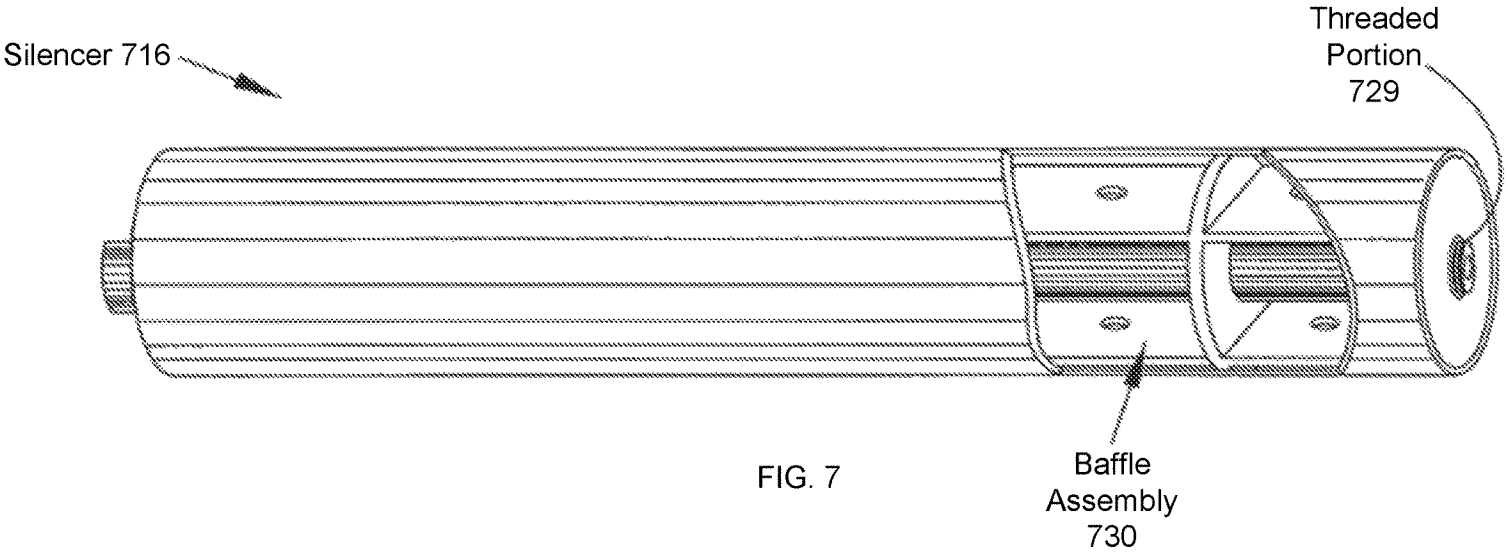

FIG. 7 shows the complete silencer of the present invention mounted on a gun barrel, with a cutaway showing interior baffles.

Figure 8:
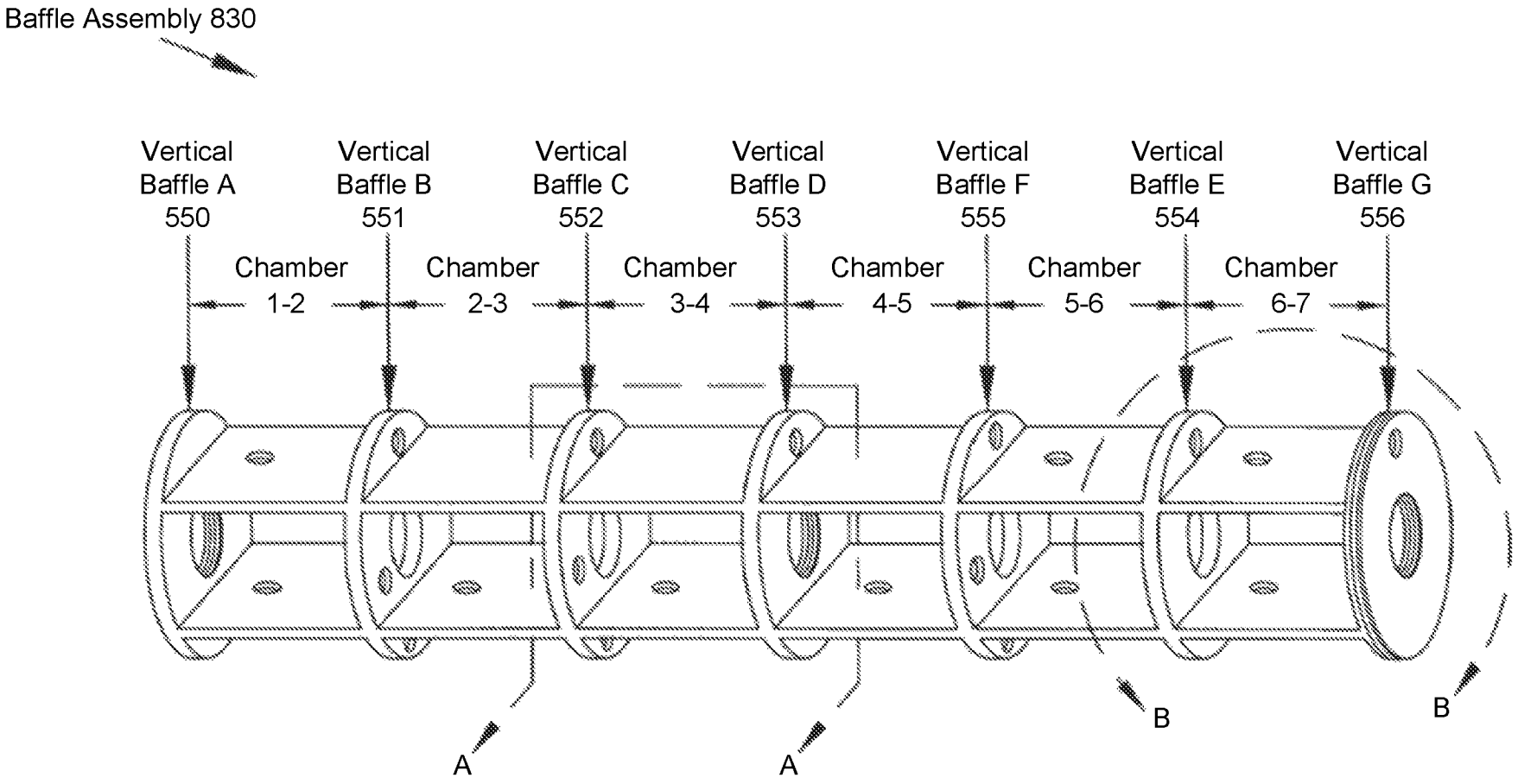

FIG. 8 shows the silencer numbered baffle/chamber assembly of the present invention with arrows A-A and B-B indicating a cutaway and another view, respectively.

Figure 9:
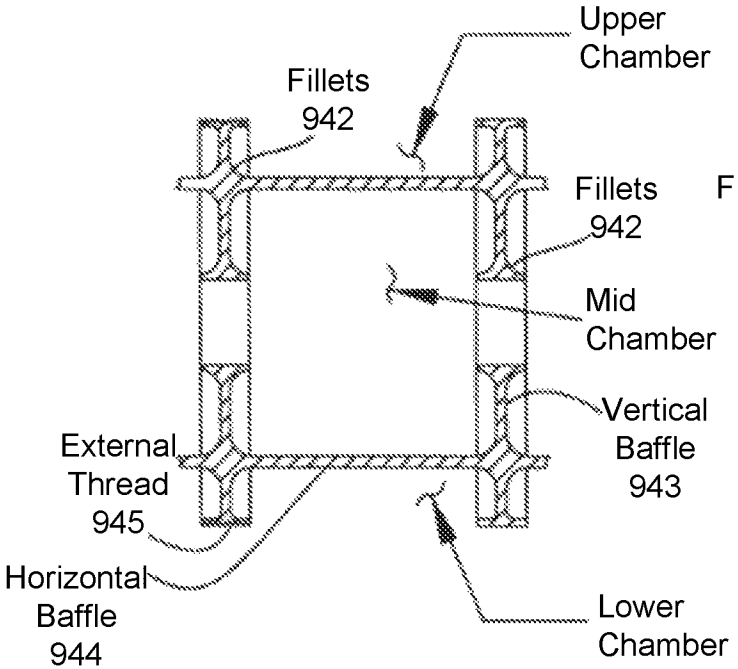

FIG. 9 shows a cutaway section A-A from FIG. 8, showing fillets on the vertical and or horizontal baffles. Also, external threads on the baffle walls are shown and embedded chambers are labeled.

Figure 10:
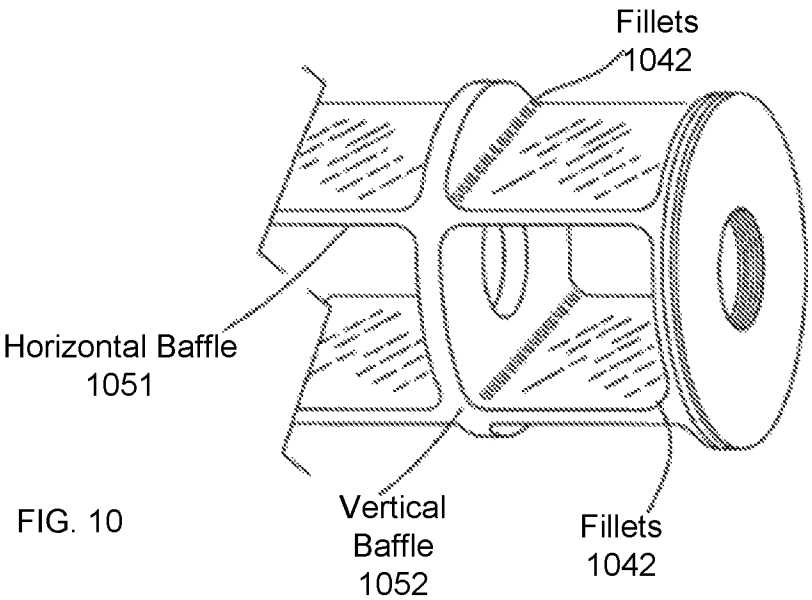

FIG. 10 shows fillets on the horizontal and vertical baffles to strengthen the assembly and allow thinner baffle walls, also resulting in lower weight.

Figure 11:
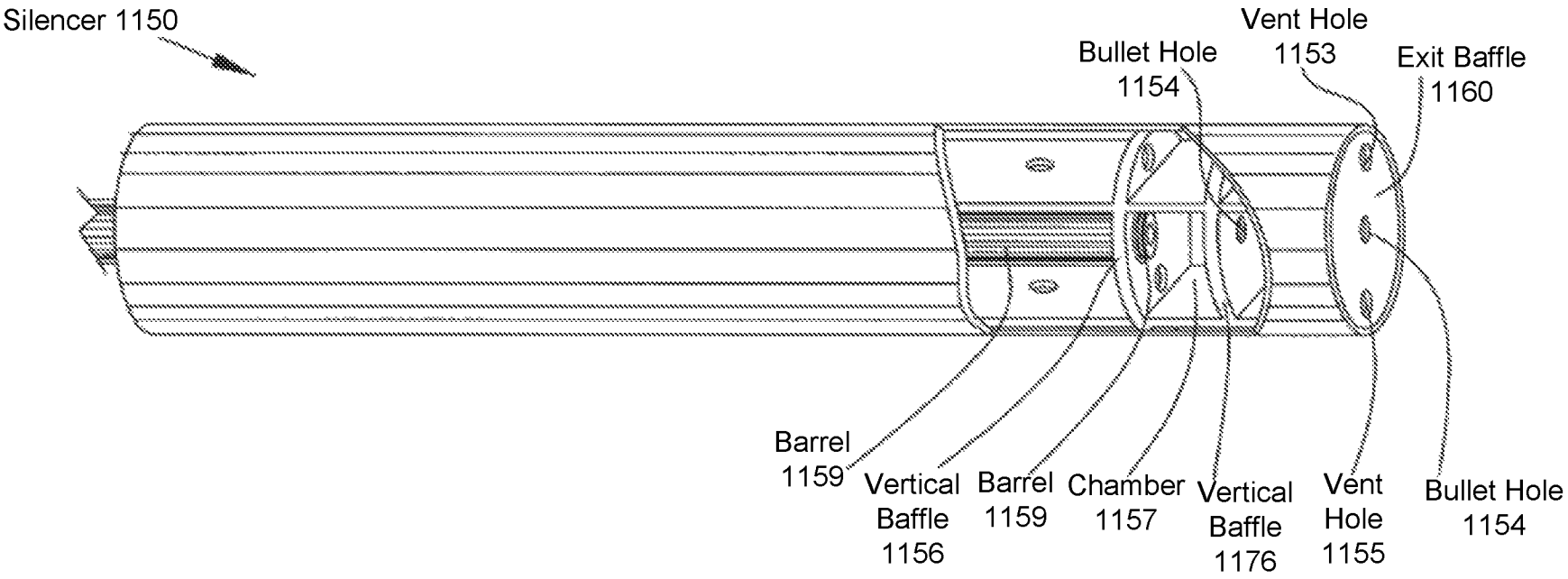

FIG. 11 is an overall view of a silencer mounted over a gun barrel according to a Second Embodiment of present invention.

Figure 12:
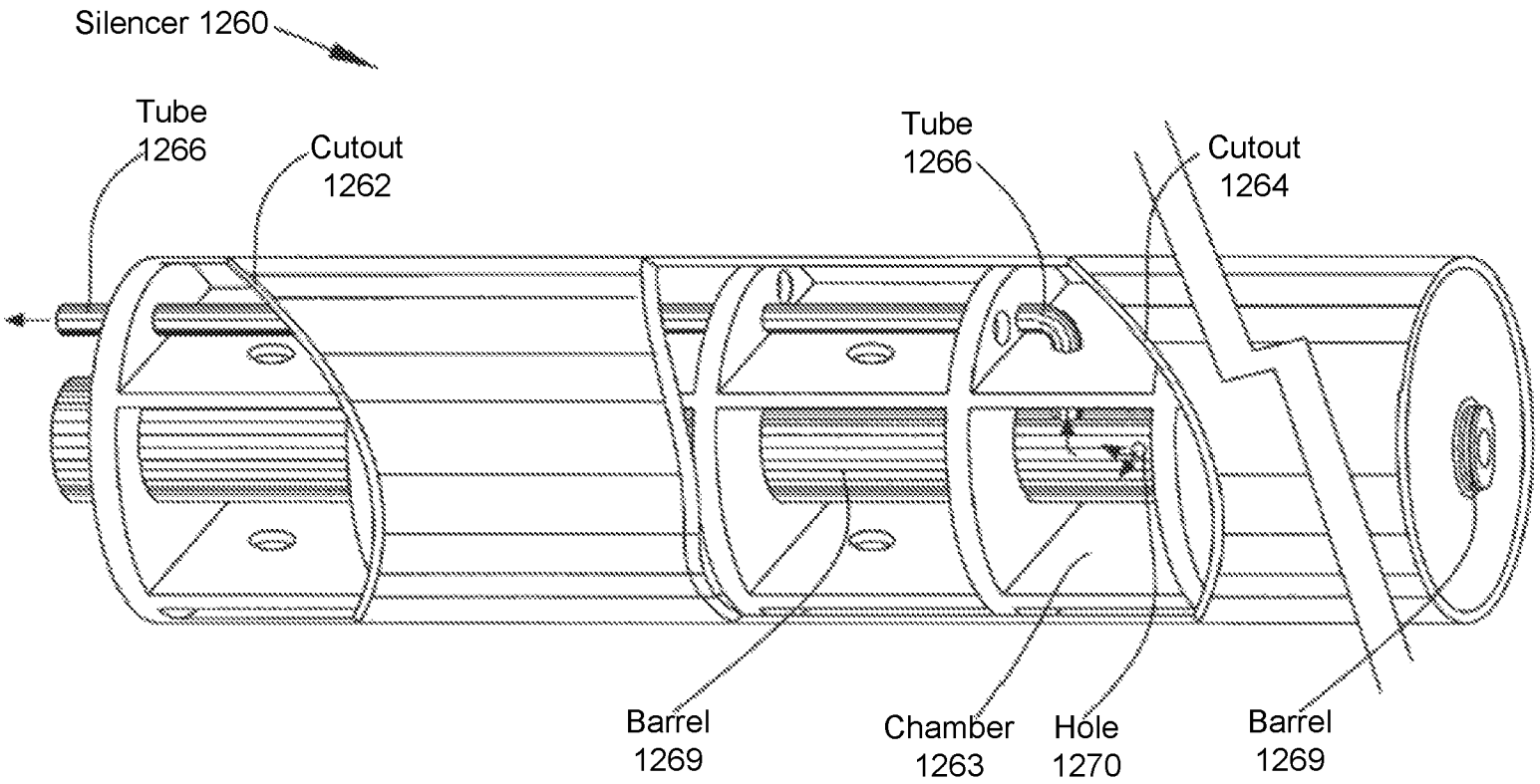

FIG. 12 is an overall view of a silencer mounted over a gun barrel according to a Third Embodiment of present invention.

Figure 13:
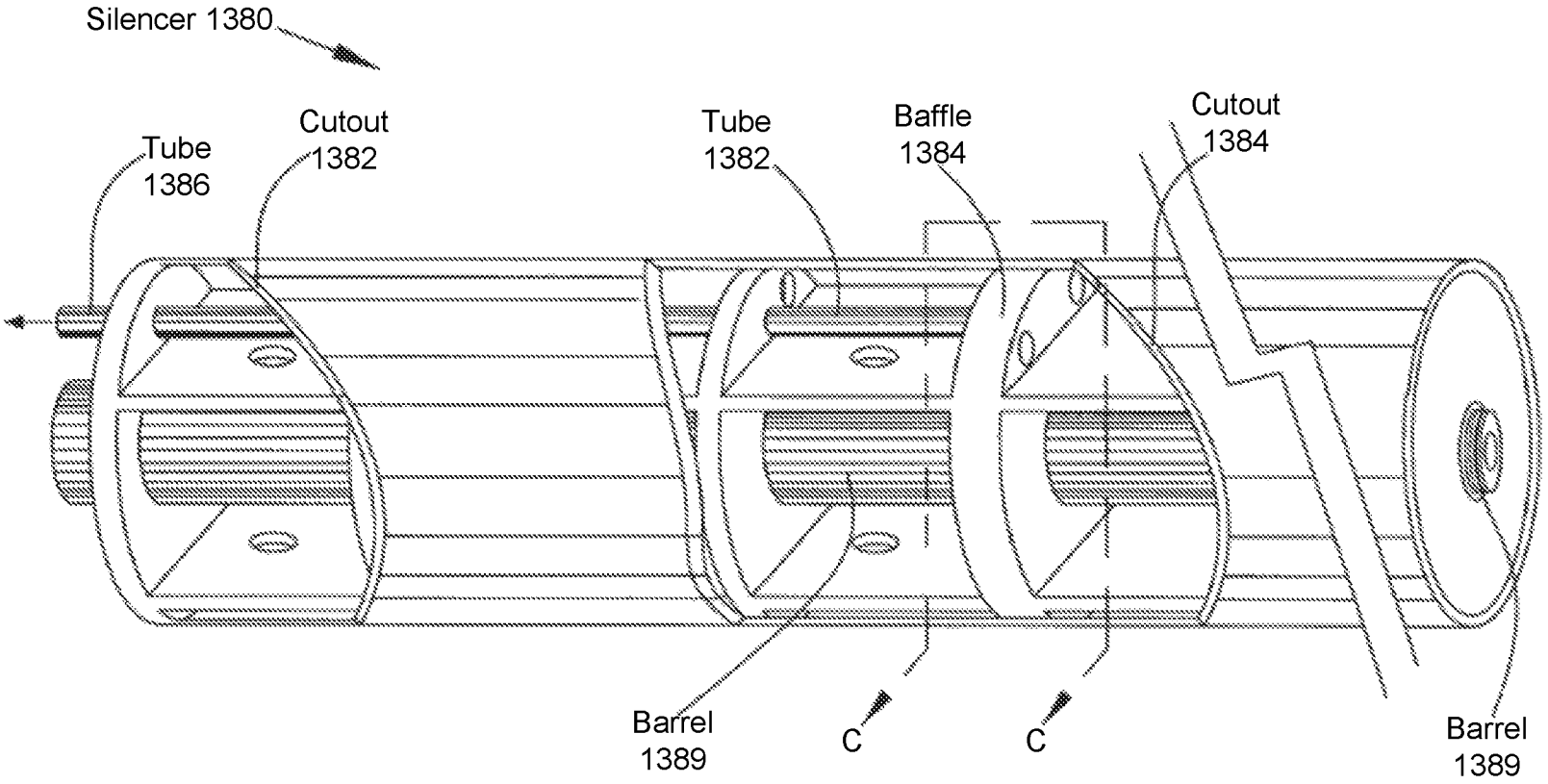

FIG. 13 is an overall view of a silencer mounted over a gun barrel according to a Fourth Embodiment of present invention.

Figure 14:
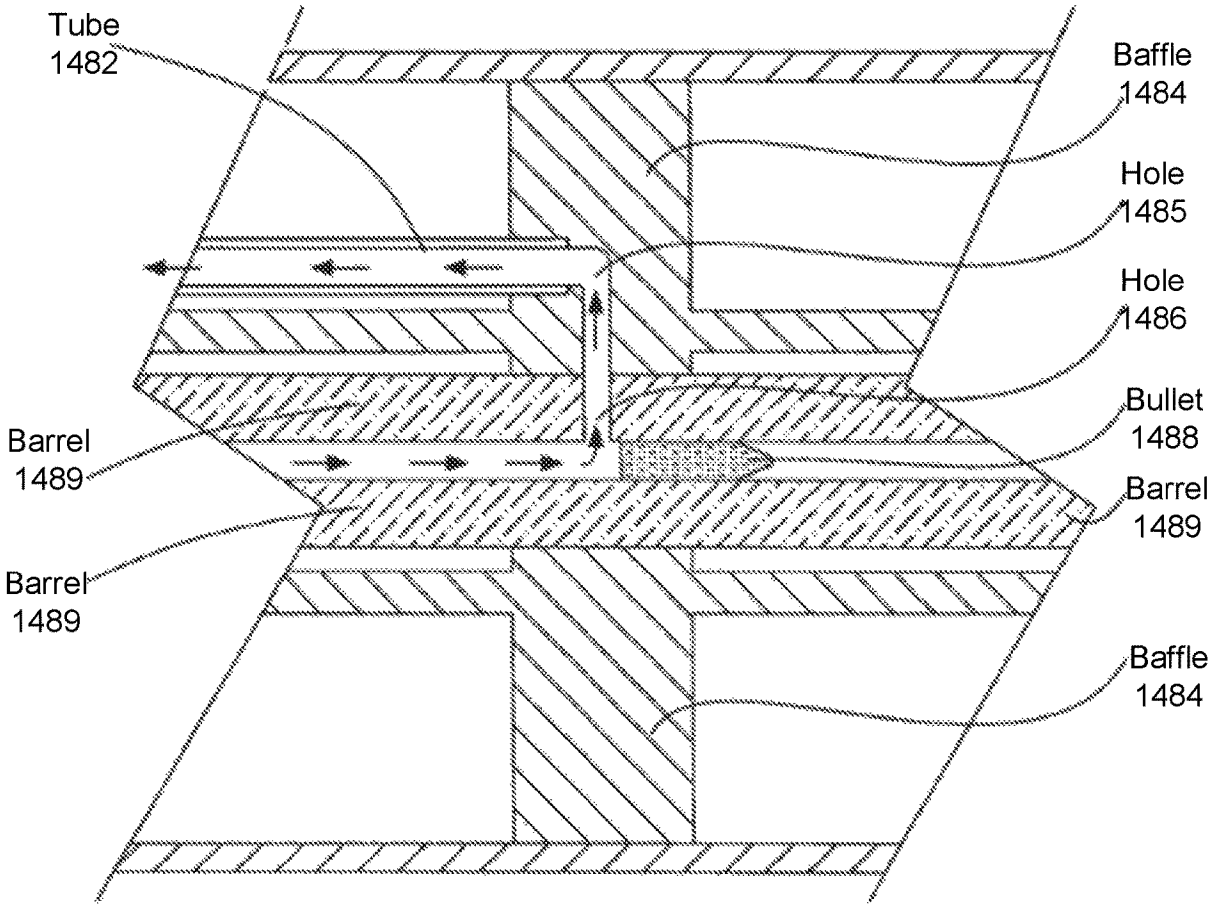

FIG. 14 is a sectional view of a silencer mounted over a gun barrel according to the Fourth Embodiment of the present invention.

Figure 15:
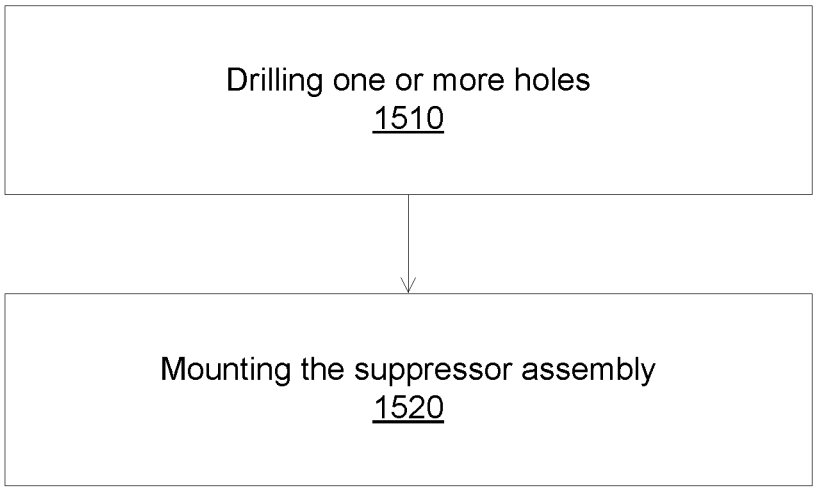

FIG. 15 is a flowchart of a method for preparing and mounting a firearm with a suppressor of the present invention.

Figure 16:
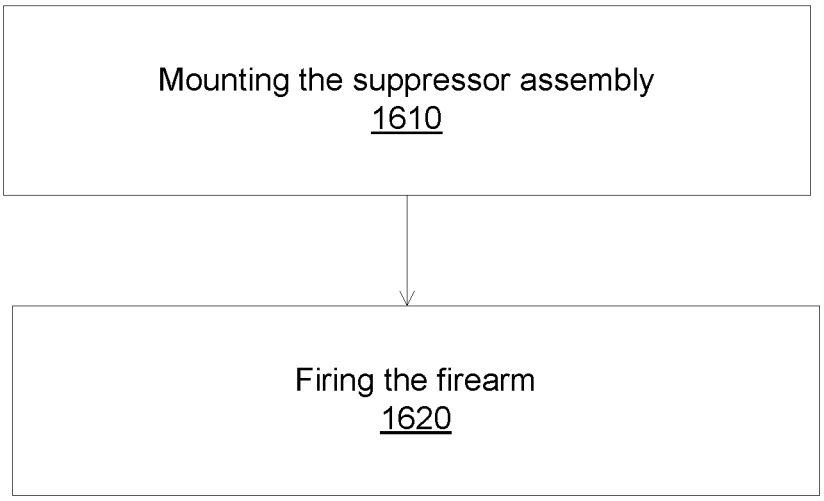

FIG. 16 is a flowchart of a method for operating a firearm with a mounted suppressor of the present invention.

DETAILED DESCRIPTION

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Now therefore, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Thus, for example, any sequence(s) and/or temporal order of stages of various processes or methods that are described herein are illustrative and not restrictive.

Accordingly, it should be understood that, although stages of various processes or methods may be shown and described as being in a sequence or temporal order, the stages of any such processes or methods are not limited to being carried out in any particular sequence or order, absent an indication otherwise. Indeed, the stages in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein (as understood by the ordinary artisan based on the contextual use of such terms) differs in any way from any particular dictionary definition of such term, it is intended that the meaning of the term as understood by the ordinary artisan should prevail.

Regarding applicability of 35 U.S.C. § 112, 6, no claim element is intended to be read in accordance with this statutory provision unless the explicit phrase "means for" or "stage for" is actually used in such claim element, whereupon this statutory provision is intended to apply in the interpretation of such claim element.

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods.

Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

The present disclosure includes many aspects and features. Moreover, while many aspects and features relate to, and are described in, the context of, embodiments of the present disclosure are not limited to use only in this context.

In at least one embodiment, the present invention discloses a system and a method for limiting the sudden expansion of propellant gasses, products of combustion when firing a gun, exiting a barrel of a gun, which otherwise would result in a very loud noise, sharp recoil of the gun, and a pronounced muzzle flash if released unrestricted. By utilizing two or more completely segregated, or partially segregated, expansion chambers, the gasses can be allowed to sequentially expand and cool under tightly controlled conditions governed by the size and location of holes, or passageways, in the barrel which communicate with the interior of the expansion tube that encompasses the barrel. The expanding gasses are further controlled by the locations and volumes of each segregated expansion chamber, and holes in the structural vertical and horizontal bulkheads of the expansion tube, which can "steer" the gasses in order to achieve easy expansion as well as gas flow disruption goals by design.

The said suppressor assembly comprises a tube, extending more or less the length of the barrel, which is divided internally by vertical bulkheads that segregate the expansion chambers. Gastight, or nearly gastight, horizontal bulkheads provide either unhindered or "baffled" large expansion volume and may serve to establish mechanical integrity of the silencer baffle assembly, as well as to provide a venue to purposely direct the gasses by means of holes installed into selected horizontal and vertical baffles, which may be configured to sequentially bleed off the gasses into the atmosphere. For example, the gasses of two or more chambers could be directed to collide with each other and the resultant gasses allowed to exit the encompassing tube by a separate small tube which exits the tube at the barrel end. In another example, a main expansion chamber may enclose a shelf that is open at the rear so that gasses may expand to the rear and up through the opening so that those gasses travel up and forward over the top of the shelf. By this method of holes allowing communication between the bore of a barrel and the encompassing expansion tube, segregating vertical and horizontal bulkheads purposely constructed as necessary for a given gunpowder charge, bullet weight, diameter of a given bullet, and desired exit velocity of the bullet, the present invention makes possible the expansion and cooling of combusted gunpowder gasses in a highly controlled environment to meet required goals of reduction or elimination of the noise, recoil, and muzzle flash of a gunshot.

In the present invention, as a bullet is driven down a barrel propelled by the expanding gasses of the combusted gunpowder, selected holes which may have been cut or drilled into the bore of the barrel allow expanding gasses to release and cool into at least two or more expansion chambers, segregated one from the other(s). The said plurality of expansion chambers and baffles are fitted over the barrel of the gun and are thus effectively sealed from each other, giving the capability of steering barrel vented gasses from one chamber to another as desired by prearranged holes in the said baffles and predetermined areas of the said gun barrel. As previously stated, instead of capturing and interfering with the expanding gasses after exiting the barrel as seen in prior art designs, relatively small holes may be placed perpendicularly through the barrel and into the bore of the said barrel over which an expansion tube and baffle assembly is mounted. The gun barrel length may be approximately that of an unsuppressed gun. Ideally, the said suppressor encompasses the entire external portion of the said barrel, which holes may be segregated by vertical and horizontal bulkheads (see FIG. 7) within the expansion tube so as to facilitate the directing of the expanding products of gunpowder combustion in a sequentially controlled manner. The encompassing tube may be threaded onto the barrel at several places along the barrel. Each threaded attachment forms the basis for a gastight bulkhead oriented perpendicular to the encompassing tube.

The enclosed volume of the expansion tube, being approximately the length of the barrel, fourteen or so inches on a sixteen and a half inch barrel, for example, and two and three eighth inches outside diameter, is on the order of thirty seven cubic inches, the volume of the barrel, typically three quarters of an inch or so in diameter, being accounted for and subtracted.

Thus, with a greatly increased volume of enclosed expansion space available, this present invention is certain to substantially reduce any acoustic signature of the gunshot over that of a suppressor mounted external to the barrel. Because in this present invention, the overall length of the gun is unchanged, the gun is less unwieldy than it would be with a suppressor mounted at the end, such as, e.g., the distal portion of a barrel.

FIG. 1 shows a typical firearm 100 as used by both civilian and some military personnel. It may comprise a stock 102, a receiver 103, a bolt 104, a barrel 105, a prior art silencer 106, a bullet exit opening 107, and a firing trigger 108. Note that the prior art silencer 106 has been fitted at the distal portion (muzzle) of the gun barrel 105.

First Embodiment of the Present Invention

FIG. 2 shows a typical firearm 200 capable of being used by both civilian and some military personnel. It comprises a stock 212, a receiver 213, a bolt 214, a specially modified barrel 215, a bore 217 wherein the bullet travels, a firing trigger 218 and a silencer 216, built according to the present invention. Note that the silencer 216 has been fitted over the gun barrel 215. This results in substantially no change in the overall length of the gun 210. Silencer 216 may comprise an elongate body having a bullet entry end, an opposed bullet exit end, and a longitudinal axis that aligns with that of gun barrel 215. A bullet pathway can be defined in the elongate body that extends longitudinally from the bullet entry end to the bullet exit end. In some embodiments, if desired, the bullet pathway can be offset from the longitudinal axis of the elongate body. The silencer may also comprise a baffle assembly oriented coaxially within the silencer 216 and gun barrel 215. The baffle assembly may include a first end that may include a first hole, and a second end that may include a second hole. The second end may be located opposite the first end of the assembly.

FIG. 3 shows a close-up view of the present invention gun barrel 315. For purposes of this teaching it is divided into three imaginary zones; A, B, and C, which will be discussed hereafter. Holes 319, 320 within zone A may be cut or drilled thru into the bore of the barrel 315. These are at the highest pressure points in the bore 317 of the barrel 315 where partial venting of the bore 317 begins. Within zone B, more holes 323, 324 may be drilled to further vent the expanding gasses which are now at a lower pressure. In some embodiments, corresponding holes may be drilled on the opposite side of the gun barrel, e.g., spaced 180-degrees, of holes 319, 320 of zone A and holes 323, 324 of zone B. In addition, holes 319, 320 of zone A and holes 323, 324 of zone B may be aligned vertically, or concentrically relative to the barrel, instead of horizontally, as seen in the figure. Although said figure shows pairs of holes in the said zones, more or less holes may be used in each set, such as, e.g., a single hole or triple hole configuration. There may also be more than a single set of holes in each of zone A and zone B, such as, e.g., zone A may comprise a pair of holes as shown in the figure, but zone B may comprise two pairs of holes; or, zone A may comprise a single hole, and zone B may comprise a triple hole configuration. A set comprising three or more holes may be oriented in a straight line or a polygonal shape, such as, e.g., a triangle or a square. Generally, it is desirable to drill small holes that break thru in the lower crest of the bore 317 rifling rather than the land portion since this is where there is less contact pressure on the bullets surface.

Final venting is performed in zone C where the pressure is the lowest of the three zones. Zone C may comprise one or more vent holes 325 near the muzzle portion, or bullet exit point, of the barrel 315. The purpose of these holes is to reduce the exhaust pressure to a minimum thus greatly reducing the loud bang when the bullet leaves the muzzle; however, careful consideration may be taken to not slow the bullet down significantly since this can affect the bullet's spin and may result in projectile instability.

In some embodiments, in addition to the circumferential vent holes 325, one or more sets of holes oriented longitudinally axial, such as seen in barrel hole 319 and barrel hole 320 of zone A and barrel hole 323 and barrel hole 324 of zone B of FIG. 3, may be disposed in zone C for increasing gas expulsion out of the barrel 315. The axial holes of zones A, B, and C may be configured to increase in size from one end of the barrel 315 to the other, such as, e.g., the holes increase in diameter from the proximal end to the distal end of the firearm, or vice versa. This configuration may provide the benefit of controlling the pressure released from combustion, which may affect the noise generated in addition to how the bullet fires, e.g., pressure may be stabilized if the holes become progressively smaller in diameter as it approaches the distal end. In addition, the axial holes of zones A, B, and C may be configured to increase in quantity from one end of the barrel 315 to the other, such as, e.g., the holes may increase in frequency from the distal end to the proximal end of the firearm, or vice versa. This configuration may provide similar benefits of controlling pressure release as previously described. Zone C gas expansion and venting will be discussed further as the teaching continues.

In some embodiments, barrel hole 319, barrel hole 320, and barrel hole 323, barrel hole 324, and vent holes 325 may comprise openings that are angled or curved to facilitate disruptive gas release patterns during operation, e.g., when a bullet is fired. The holes may be circular, slot-shaped (extended circular), triangle, square, or any other polygon shape. Determination of hole-pattern configuration, orientation, shape, and quantity may be based on specifications of the firearm and bullet with which the suppressor will be attached and operated.

A threaded section 329 is shown on the barrel 315 at distal portion of said barrel 315. There may be more threaded sections on the barrel 315 but they are not shown for purposes of simplicity of the teaching. In fact, the threaded fastening method shown is only an example. To those skilled in the art, there may be other methods of fastening the said silencer assembly and are hereby incorporated by reference.

FIG. 4 shows a skeletal structure of the internals of a silencer 430's baffle assembly of the present invention, devoid of its outer housing tube with seven vertical baffles, namely, vertical baffle A 432, vertical baffle B 434, vertical baffle C 436, vertical baffle D 438, vertical baffle E 440, vertical baffle F 442, and vertical baffle G 444; six lower horizontal baffle 450*s*; and six upper horizontal baffle 460*s*. All of the vertical baffles have opening 434*s* in them to snugly fit over a gun barrel. A number of hole 433*s* are shown in predetermined locations, namely, on the lower horizontal baffle 450*s*, upper horizontal baffle 460*s*, and the seven vertical baffle baffles. In some embodiments, hole 433 may comprise openings that are angled or curved to facilitate disruptive gas release patterns during operation, e.g., when a bullet is fired. The holes may be circular, slot-shaped (extended circular), triangle, square, or any other polygonal shape. Determination of hole pattern configuration, orientation, shape, and quantity may be based on specifications of the firearm and bullet with which the suppressor will be attached and operated. In this teaching the mid vertical baffle D 438 will be called the Primary Segregation Bulkhead, while the vertical baffle F 442 will be called the Secondary Segregation Bulkhead.

In this example embodiment, seven hole 434*s* are provided, one for each of the vertical baffles for precise fitting over a corresponding hole that is cut or drilled into gun barrel 215 as shown in FIG. 2 as a complete assembly, and firearm barrel 515 in FIG. 5 as a partial assembly. Three of the said opening 424*s* may comprise internal thread A 480, internal thread B 482, and internal thread C 484 for mounting to a gun barrel with matching complementary threads (not shown). Also, the distal muzzle-end vertical baffle G 444 and the proximal vertical baffle A 480 may be fitted with external thread A 490 and external thread B 492 for fastening the skeletal structure 430 to tubular enclosure 716 as illustrated in FIG. 7.

FIG. 5 shows a gun barrel 515 fastened to the internals of the silencer assembly 430 shown in FIG. 4. Once again, the housing is removed for clarity. Let us first look at the placement of the various baffle vent hole 533*s*. About twenty are shown in this example embodiment. There may be seven vertical baffles: vertical baffle A 550, vertical baffle B 551, vertical baffle C 552, vertical baffle D 553, vertical baffle E 554, vertical baffle F 555, and vertical baffle G 556. The proximal vertical baffle A 550 may also function as a back wall, while the distal vertical baffle G 556 may also function as a front wall as well as an expended gas exhaust port. In this teaching, they may be considered baffles. The vertical baffles are arbitrarily numbered for ease of discussion (see FIG. 8), number one being the proximal wall, while number seven is the distal or muzzle-end wall.

When a tubular enclosure 640 (see FIG. 6) is placed over the assembly 530 of FIG. 5, we have six separate chambers formed. The plurality of chambers may be in fluid communication with each other via a plurality of holes. We shall call them chambers 1-2, 2-3, 3-4, 4-5, 5-6 and 6-7. With a housing tube in place (not shown), these said chambers are clearly illustrated in FIG. 8. On closer inspection, each of these said chambers are sub-divided into three separate chambers, namely lower, mid and upper chamber levels. Since FIG. 5 is visually crowded, these said three separate levels are clearly labeled in a partial sectional view in FIG. 9 with the tubular enclosure 640 not shown. If there were no holes 533 drilled on any of the vertical or horizontal baffles, there would be little or no gas pressure communication between them since the said tubular enclosure 640 is an airtight fit around all sides of silencer assembly 430, firearm barrel 515, vertical baffle A 550, vertical baffle B 551, vertical baffle C 552, vertical baffle D 553, vertical baffle E 554, vertical baffle F 555, vertical baffle G 556, upper horizontal baffle 570 and lower horizontal baffle 575. In effect, there are 18 separate expansion chambers. Where the hole 433*s* are disposed will determine where the said expanding gasses will travel. The size and quantity of the hole 433*s* will govern the rate of the said expanding gas rate.

When the trigger 218 (shown in FIG. 2) is activated, the bullet cartridge is ignited and the bullet is forced down the barrel 315 of FIG. 3. Very high-pressure gun powder gasses from the said exploded bullet cartridge are occurring in zone A of barrel 315, causing the bullet to accelerate towards the end of said zone A. When the bullet passes the barrel hole 319 and barrel hole 320 of barrel 315, a portion of the aforementioned gasses begin to vent into the expansion chamber 3-4 formed by vertical baffle C 552 and vertical baffle D 553, and associated upper horizontal baffle 570 and lower horizontal baffle 572 connecting said vertical baffles. The holes provided in this said chamber will now direct the said gasses backward into chamber 2-3 and subsequently into the chamber 1-2, as shown by the arrows depicting the gas flow. The Primary Segregation Bulkhead serves to vent said combustion gasses backwards and up thru upper horizontal baffle 570 into the upper portion of chamber 1-2. The said expanding gasses now move forward to upper chamber 2-3 and then to upper chamber 3-4 and then to upper chamber 4-5. While all this is occurring, the bullet passes barrel hole 323 and barrel hole 324 allowing additional gasses to vent into chamber 4-5. These said gasses now vent into chamber 5-6 as illustrated by the arrows, colliding and mixing with the gasses originating from barrel hole 319 and barrel hole 320 discussed previously. Note that the vertical baffle F 555 is the Secondary Segregation Bulkhead and serves to force the mixing of the gasses originating from barrel hole 319, barrel hole 320, barrel hole 323 and barrel hole 324. The baffle chambers serve to control, delay, and divert the flow, expansion, and exiting of propellant gasses, and also to reduce temperature and entropy as the gasses ultimately exit the device. Complex gas pressure-front node and anti-node wave-front effects now occur as the said two gasses collide which expend energy (subsequently cooling) and reducing acoustic noise. These said gasses now move to the upper portion of chamber 6-7 and out to the atmosphere as indicated by the arrows originating from barrel hole 523 and barrel hole 524, finally exiting out of vent hole 590 on the muzzle-end vertical baffle G 556.

So far, all the chambers of the silencer assembly 430 have been utilized with the exception of the mid and lower chamber 6-7. When the aforementioned bullet passes vent holes 525 in zone C, a sudden further venting is performed by the multiple vent holes 525, causing gasses to flow freely into mid and lower chamber 6-7 thru baffle hole 595, and then out into the atmosphere thru vent hole 599, as before, the said arrows showing the general direction.

In summary, expanding and cooling propellant gasses from a gun barrel may be steered, or directed, into expansion chambers completely separated from other expansion chambers—or commingled with other expansion chambers—as needed for maximum expansion and cooling for a given cartridge. In addition, the separate expansion chambers can be vented to atmosphere completely independent of other expansion chambers, or commingled as best suited for maximum expansion and cooling.

It might be said at this juncture that the illustrating arrows are only there for illustration; in reality there are violent gas turbulences and pressure waves occurring. In the various figures the said seven vertical baffles are shown essentially equidistantly spaced and vertical. In actual practice, they may be non-equidistantly spaced and non-perfectly vertical to mitigate any sonic resonances that may be generated by the combustion gas pressure fronts. This technique is known in the art, but is not illustrated here. As the bullet leaves the muzzle, there is very little noise since most of the high pressure has been vented and cooled by expansion. Using separate chambers for venting to the atmosphere is a unique feature of the present invention.

FIG. 6 shows a gun barrel outfitted with a suppressor of the present invention. The suppressor may comprise tubular enclosure 640, which may be generally hollow and cylindrical, and in combination with the baffle assembly forms the expansion chambers. Tubular enclosure 640 may represent other geometric shapes that may be suitable for use in a suppressor, such as, e.g., a prism, a box, or any other polygon. In some embodiments, an optional outer sleeve may be used to inhibit overheating of the outer surface of tubular enclosure 640 during operation, and inhibits burn injuries to users from touching the tubular enclosure 640 following prolonged use, such as, e.g., after firing hundreds of rounds of ammunition. The outer sleeve may preferably be made of a material comprising low thermal conductivity, such as, e.g., carbon fiber, and/or sound absorbing or dampening properties, such as, e.g., a mesh formed by weaving a fibrous resin material capable of reducing exhaust sounds. The tube 641 has an interior threaded portion 642 and 643 used for fastening to the silencer assembly 430 as depicted in FIG. 7. Also, a third interior thread (not shown) can be placed to engage with one of the approximately mid-point vertical baffles to offer further rigidity and chamber segregation to the said silencer structure. It should be noted that this is only an example since there are other ways this can be accomplished by those skilled in the art, for example, instead of a single-structure baffle assembly as seen, e.g. a monolithic structure, a modular construction may be employed.

In some embodiments, a modular baffle assembly of the present invention may be divided into multiple parts, such as, e.g., three or five, and each part may comprise an internal threaded portion for separately fastening to a gun barrel, e.g., each internal threaded portion corresponds to a matching external threaded portion on the gun barrel such that the baffle assembly is joined together to define a continuous bore configured to be coaxially aligned with the gun barrel. Seals may be used to prevent leakages between the parts when they are assembled on a gun barrel and during operation of the firearm. Adjoining edges of each part may be configured to mate and lock, such as comprising a groove and tongue mechanism which may be mated by twisting the parts together onto the barrel. In addition or in substitution, a tension force may be used to couple and stabilizes adjoining pairs of the modular assembly parts, such as, e.g., a nut may be fastened to the distal end of the baffle assembly. An amount of the tension force applied to the modular assembly may depend on the degree to which the nut is rotated, e.g., threaded onto the distal end of the suppressor.

FIG. 7 shows the complete silencer 716 of the present invention mounted on a gun barrel 215, with a cutaway showing the silencer baffle assembly 730. The muzzle end of the barrel 215 is shown with a threaded portion 729 mating with the distal wall of the silencer baffle assembly 730. In some embodiments, baffle assembly 730 may be coated with wear resistant and/or thermal coating, such as, e.g., a high temperature ceramic coating that has low heat transmission and high heat dissipative properties to limit heat degradation.

FIG. 8 shows the silencer baffle assembly 30 of the present invention with arrows A-A and B-B indicating a cutaway section and arrows B-B indicating an enlarged section. Section A-A will be discussed in the following FIG. 9 description, while the encircled B-B area will be discussed next.

FIG. 9 shows a cutaway section A-A from FIG. 8, showing fillets 942 on vertical baffle 943 and horizontal baffle 944. A fillet may be a rounding of the angle formed between vertical baffle 943 and horizontal baffle 944. Also, an example external thread 945 on a baffle wall is shown as discussed previously.

FIG. 10 shows a partial view B-B of FIG. 8 as an alternate design of the baffle assembly using fillets 1042 on the horizontal baffle 1051 and vertical baffle 1052 to strengthen the assembly and allow thinner baffle walls, also resulting in lower weight.

Second Embodiment of the Present Invention

FIG. 11 shows a perspective view of silencer 1150 (with a cutout as in FIG. 7) mounted on a gun barrel 1159 wherein the said barrel 1159 does not extend to the distal portion of the silencer 1150, but is mounted back a small distance to vertical baffle 1156 with the next vertical baffle 1176 being also shown as an example.

Vent hole 1153 and vent hole 1155 are shown on the bullet exit baffle 1160 along with the bullet exit hole 1154. Note that vertical baffle 1156 and exit baffle 1160 have bullet hole 1154 sized for the exiting bullet to pass thru.

Now the muzzle of gun barrel 1159 noses into chamber 1157. This design may be desirable to reduce the remaining muzzle blast exiting the said barrel 1159 as the bullet leaves the said firearm, especially when large energy rounds are fired.

This example is shown for the completeness of this disclosure, though it is not necessarily the most desirable since the first embodiment does not allow the bullet to ever be affected by suppressor combustion gasses but leaves the barrel in a normal manner as in an unsuppressed firearm.

Third Embodiment of the Present Invention

FIG. 12 shows a perspective view of silencer 1260 with cutout 1262 and cutout 1264 showing the inner workings, mounted on a gun barrel 1269 with the said barrel 1269 once again protrudes to the distal portion of the silencer 1260. A tube 1266 is shown inserted from the proximal end of the silencer 1260 wall and into a predetermined expansion chamber 1263 which in this example is a mid-chamber. Note that tube 1266 is bent and protrudes into the said mid-chamber 1263 which is not vented anywhere else but thru the tube 1266. High pressure gasses from the barrel 1269 bore enter into the mid-chamber 1263 and into tube 1262 and finally into the gun's spent cartridge ejection mechanism (not shown) which is used for gas ejection of expended bullet cartridges. The arrows in FIG. 12 illustrate the said gas path.

Gas ejection is commonly used in most modern firearms including military machine guns etc. Most semi-automatic and fully automatic firearms use a fairly high pressure of gas to perform this function. This present example uses a lower pressure since the gas ejection from barrel 1269's hole 1270 has a chance to partially expand in the said mid-chamber 1263. Consequently, the said gas ejection system would have to be a lower pressure operating system. To those skilled in the art this would not present a great difficulty. If a conventional high-pressure system is desired, the next embodiment will discuss it.

Fourth Embodiment of the Present Invention

FIG. 13 shows a perspective view of silencer 1380 with cutout 1382 and cutout 1384 showing the inner workings, mounted on a gun barrel 1389 with the said barrel 1389 once again protrudes to the distal portion of the silence 1380. A tube 1386 is shown inserted from the proximal end of the silencer 1380 wall and into a predetermined baffle wall 1384. Broken arrows C-C indicate a sectional area to be viewed in FIG. 14.

Referring to FIG. 14, a tube 1482 is shown (inserted from the proximal end of the silencer 1380 shown in FIG. 13) inserted into a predetermined baffle wall 1484. The said baffle 1484 has hole 1485 placed as indicated which matches hole 1486 on the gun barrel 1489. A bullet 1488 in transit is shown for illustrative purposes. High pressure gasses from the barrel 1489 bore enter into hole 1486 and then hole 1485 and finally into the tube 1482 and out into the gun's spent cartridge ejection mechanism (not shown) which is used for gas ejection of expended bullet cartridges. The arrows in FIG. 14 illustrate the said gas path.

FIG. 15 is a flowchart of a method for preparing and mounting a firearm with a suppressor of the present invention. Operation 1510 cuts or drills one or more holes into a bore of a gun barrel for alignment with corresponding holes of the suppressor assembly. The holes can be any shape, such as, e.g., circular, slot-shaped (extended circular), triangle, square, or any other polygonal shape, and configured to expel propellant gasses from the gun barrel one or more expansion chambers. Determination of hole pattern configuration, orientation, shape, and quantity may be based on specifications of the firearm and bullet with which the suppressor will be attached and operated. Operation 1520 mounts the suppressor assembly by threadably coupling the suppressor assembly onto the gun barrel without increasing the length of the barrel. The suppressor assembly may comprise two or more segregated, or partially segregated, expansion chambers for sequentially expanding the propellant gasses through the use of horizontal and vertical bulkheads comprising one or more holes for directing the gasses out of the suppressor and into the atmosphere at lower enthalpy and entropy, thus inhibiting noise level.

FIG. 16 is a flowchart of a method for operating a firearm with a mounted suppressor of the present invention. Operation 1610 mounts the suppressor assembly by threadably coupling the suppressor assembly onto the gun barrel without increasing the length of the barrel. The suppressor assembly may comprise two or more segregated, or partially segregated, expansion chambers for sequentially expanding the propellant gasses through the use of horizontal and vertical bulkheads comprising one or more holes for directing the gasses out of the suppressor and into the atmosphere at lower enthalpy and entropy, thus inhibiting noise level. Operation 1620 fires the firearm comprising the suppressor assembly. The firearm can be any type of firearm operating in semi-automatic mode or automatic mode regardless of action type including direct impingement, short stroke gas piston, long stroke gas piston, simple blowback, lever delayed blowback, roller-delayed blowback, gas delayed blowback, and toggle delayed blowback.

Definition of Terms

For the purposes of the present disclosure, the Abstract portion of this document is to enable the public, and especially the scientists, engineers, and practitioners in the art who are not familiar with patent or legal terms or phraseology, to determine quickly from a cursory inspection, the nature and essence of the technical disclosure of the application. The Abstract is neither intended to define the inventive concept(s) of the application, which is measured by the claims, nor is it intended to be limiting as to the scope of the inventive concept(s) in any way.

For the purposes of the present disclosure, the phrase "A and/or B" means (A), (B), or (A and B).

For the purposes of the present disclosure, the phrase "A, B, and/or C" means (A), (B), (C), (A and B), (A and C), (B and C), or (A, B and C).

As used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The descriptions may use perspective-based descriptions such as top/bottom, in/out, over/under and the like. Such descriptions are merely used to facilitate the discussion and are not intended to restrict the application of embodiments described herein to a particular orientation.

Throughout this teaching, the term "distal" is in reference with the object; distal being further away, while proximal would be closer to the object. For example, a gun's proximal point is the stock portion, while the distal point is the end of the gun's barrel.

The description may use the phrases "in an embodiment," or "in embodiments," which may each refer to one or more of the same or different embodiments. Furthermore, the terms "comprising", "including", "having", and the like as used with respect to embodiments of the present disclosure, are synonymous.

The terms "disclosure" and "teaching" are used synonymously.

The term "coupled with", along with its derivatives, may be used herein. "Coupled" may mean one or more of the following. "Coupled" may mean that two or more elements are in direct physical contact. However, "coupled" may also mean that two or more elements indirectly contact each other, but yet still cooperate or interact with each other, and may mean that one or more other elements are coupled or connected between the elements that are said to be coupled with each other. The term "directly coupled" may mean that two or more elements are in direct contact.

The terms "Firearm", "Gun", "Weapon", "Rifle" are synonyms describing a device that is used to fire projectiles generally called "bullets" which said bullets have a dictionary definition generally as: "A projectile for firing from a rifle, revolver, or other small firearm, typically made of metal, cylindrical and pointed . . . ."

The term "tube" may refer to a dictionary defined tube or it may refer to a tube structure such as a gun silencer assembly.

The term "external thread" means a thread such as would be seen on a bolt's external diametric surface while an "internal thread" would be likened to the internal thread of a nut used for a bolt.

The term "top" or "bottom" of a device generally refers to the opposite end of the said device's base portion. As an example, for a gun in use, top would be the sight or telescope portion, while bottom would be the trigger or magazine portion.

The term "hole" or "holes" as used on the present invention is defined as generally but not limited to an essentially circular opening thru a material usually but not limited to metal. It may be drilled, milled, punched, pierced, cut with a laser etched or molded etc. It does not necessarily need to be perfectly round, but can be square, hexagonal or another shape/s. For example, laser cutting or chemical etching may produce various shape/s of polygon, star, cross etc.

The expression "mounted" generally applies to an object affixed in its place using industry professional procedures such as bolting, screwing, nailing, gluing, clinching, interference press fitting, clamping, and etc.

SUMMARY RAMIFICATIONS AND SCOPE

To those skilled in the art, the present invention can be adapted to function with any firearm operating in semi-automatic mode or automatic mode regardless of action type including direct impingement, short stroke gas piston, long stroke gas piston, simple blowback, lever delayed blowback, roller-delayed blowback, gas delayed blowback, and toggle delayed blowback.

To those skilled in the art the present invention can be adapted to function with any rifled pistol or rifle barrel regardless of action type including bolt action, bolt action repeater, lever action and future designs incorporating this invention as an integral part of the new firearm design.

To those skilled in the art there are numerous other ways than those shown here as an example to vent the gasses and are hereby incorporated by reference. Additionally, many embodiments of the present inventive silencer assembly 30, 50 and tubular enclosure 40, 52 are technologically possible. It will be apparent to those of ordinary skill in the art from the present disclosure how to implement them and are hereby incorporated by reference. For example, the entire silencer/suppressor could be another shape, such as, e.g., oval, square rectangular or an odd shape designed into a special purpose gun that may be over laid with a skin to provide multiple baffle cavities and are hereby incorporated by reference. Another way to visualize the concept is to look at a typical car muffler. It comes in many shapes and sizes, yet the singular purpose is to muffle the sound of car's exhaust gasses. The singular purpose of the present invention is to muffle the sound of a firing gun shot.

What is claimed is:

1. A firearm suppressor comprising:

a rifled barrel consisting of lands and grooves defining a bore through which a projectile travels;

selected holes placed into the grooves of said barrel allowing communication between the bore of said barrel and the exterior of said barrel;

a tubular shaped gas tight structure encompassing in entirety the said barrel and fixtures as further described attached thereto;

a plurality of vertical baffles fixed orthogonal and gas tight to the barrel extending radially to an interior aspect of said tubular shaped gas tight structure, with selected through holes placed into selected vertical baffles to allow passage of expanding gasses;

a plurality of horizontal baffles fixed parallel to the bore of said barrel, extending transversely to an interior aspect of said gas tight encompassing tubular structure, with selected through holes placed into selected horizontal baffles to allow passage of expanding gasses;

a proximal end cap bulkhead fixed gas tight to said barrel at a proximal end of the said encompassing tubular shaped structure, sealing off said encompassing tubular shaped structure;

a distal end cap bulkhead fixed at a distal end of said encompassing tubular structure fixed gas tight to said barrel in which a hole is placed allowing the exit of said projectile from the barrel, selected through holes formed in said distal end cap bulkhead allowing venting of expanding gasses to the atmosphere;

wherein a plurality of chambers are formed by said vertical baffles, said horizontal baffles, and said tubular shaped gas tight structure, wherein said selected through holes in said vertical and horizontal baffles selectively direct the expanding gasses of the products of combustion rearward, forward, up, and down.

2. The firearm suppressor of claim 1 further comprising a primary expansion chamber of selected volume formed by:

a) a primary segregation bulkhead without any through hole, placed distal to a first set of said selected holes placed into the grooves of said barrel, b) an upper and lower horizontal baffle;

c) said encompassing tubular structure, and d) the said proximal gas tight end cap, wherein said primary segregation bulkhead is configured to force expanding gases backwards towards the rear of said primary expansion chamber into adjacent chambers through selected through holes placed in said vertical and horizontal baffles all the way to said proximal end cap bulkhead, said expanding gases are then configured to vent upward above the upper horizontal baffle and back towards said distal end cap bulkhead and into the atmosphere.

3. The firearm suppressor of claim 1 further comprising a secondary segregation bulkhead fixed gas tight orthogonally to said barrel forming an expansion chamber of selected volume without said holes formed into said barrel with selected holes formed into said secondary segregation bulkhead to allow passage of expanding gas from said chambers located rearward of said secondary segregation bulkhead to be directed rearward to collide with forward traveling expanding gas and allow passage of expanding gas forward into subsequent chambers ultimately venting to atmosphere.

4. The firearm suppressor of claim 1 further comprising a set of openings in selected vertical baffles to allow gas expansion pressure to flow thru an existing tube of a direct impingement gas operating system to a generally proximal portion of a firearm.

5. The firearm suppressor of claim 1, further comprising a set of openings in selected vertical baffles to allow mechanical movement of a mechanical reloading drive rod to a generally proximal portion of the firearm.

6. The firearm suppressor of claim 4 wherein the said openings and said selected holes are circular, slot-shaped, triangle, square, or any other polygon shape.

7. The firearm suppressor of claim 1 wherein said suppressor is configured to be mounted to a firearm barrel such that the suppressor does not exceed the length of the firearm barrel.

8. The firearm suppressor of claim 1 wherein said suppressor configured to be mounted to a firearm barrel such that the suppressor does not exceed a selected distal portion length of the firearm barrel.

9. The firearm suppressor of claim 1 wherein said suppressor is thread mounted to a firearm barrel.

10. The firearm suppressor of claim 1, where said suppressor is oval, square, rectangular or an odd shape designed into a special purpose gun.

* * * * *